US009906867B2

(12) United States Patent
Bongiovi et al.

(10) Patent No.: US 9,906,867 B2
(45) Date of Patent: Feb. 27, 2018

(54) SURFACE ACOUSTIC TRANSDUCER

(71) Applicant: Bongiovi Acoustics LLC, Port St. Lucie, FL (US)

(72) Inventors: Anthony Bongiovi, Port St. Lucie, FL (US); Lawrence Robert Hamelink, Hamilton, MI (US); Brian K. Servis, Holland, MI (US); John Robert Bielski, Chesterfield, MI (US)

(73) Assignee: Bongiovi Acoustics LLC, Port St. Lucie, FL (US)

( * ) Notice: Subject to any disclaimer, the term of this patent is extended or adjusted under 35 U.S.C. 154(b) by 0 days.

(21) Appl. No.: 15/353,070

(22) Filed: Nov. 16, 2016

(65) Prior Publication Data

US 2017/0150271 A1 May 25, 2017

Related U.S. Application Data

(63) Continuation-in-part of application No. 14/942,569, filed on Nov. 16, 2015.

(51) Int. Cl.
*H04R 9/06* (2006.01)
*H04R 9/04* (2006.01)
(Continued)

(52) U.S. Cl.
CPC ..... *H04R 9/043* (2013.01); *H04R 9/025* (2013.01); *H04R 9/06* (2013.01); *H04R 9/066* (2013.01);
(Continued)

(58) Field of Classification Search
CPC ..... H04R 7/045; H04R 9/025; H04R 9/043; H04R 9/06; H04R 9/066; H04R 11/02;
(Continued)

(56) References Cited

U.S. PATENT DOCUMENTS 2,755,336 A 7/1956 Zener et al.
3,396,241 A 8/1968 Anderson et al.
(Continued)

FOREIGN PATENT DOCUMENTS

AU 2005274099 10/2010
AU 20070325096 4/2012
(Continued)

OTHER PUBLICATIONS

NovaSound Int., http://www.novasoundint.com/new_page_t.htm, 2004.

(Continued)

*Primary Examiner* — Huyen D Le
(74) *Attorney, Agent, or Firm* — Malloy & Malloy, P.L.

(57) ABSTRACT

The present invention provides for a surface acoustic transducer optimally structured to produce sound within an aircraft cabin by vibrating the interior cabin walls. Specifically, the surface acoustic transducer comprises a primary assembly comprising a voice coil assembly having a voice coil former and wire, and a transducer housing for retaining said primary assembly and a magnet therein such in movable relations. The present surface acoustic transducer may further include a spider structured to provide an improved excursion. An external housing may additionally be provided comprising a rigid retaining wall for protecting the surface acoustic transducer from potential externally applied forces and a malleable excursion cover allowing for an excursion of the primary assembly thereof.

3 Claims, 11 Drawing Sheets

(51) Int. Cl.
*H04R 11/02* (2006.01)
*H04R 9/02* (2006.01)

(52) U.S. Cl.
CPC ..... *H04R 11/02* (2013.01); *H04R 2209/027* (2013.01); *H04R 2400/03* (2013.01); *H04R 2400/07* (2013.01); *H04R 2499/13* (2013.01)

(58) Field of Classification Search
CPC ..... H04R 2209/027; H04R 2400/03; H04R 2400/07; H04R 2440/05; H04R 2499/13
USPC ..... 381/87, 152, 386, 395, 396, 398, 404, 381/412, 417, 420, 431; 340/388.1; 181/150, 199
See application file for complete search history.

(56) References Cited

U.S. PATENT DOCUMENTS 3,430,007 A 2/1969 Thielen
3,795,876 A 3/1974 Takashi et al.
3,813,687 A 5/1974 Geil
4,162,462 A 7/1979 Endoh et al.
4,184,047 A 1/1980 Langford
4,218,950 A 8/1980 Uetrecht
4,226,533 A 10/1980 Snowman
4,257,325 A 3/1981 Bertagni
4,353,035 A 10/1982 Schröder
4,356,558 A 10/1982 Owen et al.
4,363,007 A 12/1982 Haramoto et al.
4,399,474 A 8/1983 Coleman, Jr.
4,412,100 A 10/1983 Orban
4,517,415 A 5/1985 Laurence
4,538,297 A 8/1985 Waller
4,549,289 A 10/1985 Schwartz et al.
4,584,700 A 4/1986 Scholz
4,602,381 A 7/1986 Cugnini et al.
4,612,665 A 9/1986 Inami et al.
4,641,361 A 2/1987 Rosback
4,677,645 A 6/1987 Kaniwa et al.
4,696,044 A 9/1987 Waller, Jr.
4,701,953 A 10/1987 White
4,704,726 A 11/1987 Gibson
4,715,559 A 12/1987 Fuller
4,739,514 A 4/1988 Short et al.
4,815,142 A 3/1989 Imreh
4,856,068 A 8/1989 Quatieri, Jr. et al.
4,887,299 A 12/1989 Cummins et al.
4,997,058 A 3/1991 Bertagni
5,007,707 A 4/1991 Bertagni
5,073,936 A 12/1991 Gurike et al.
5,133,015 A 7/1992 Scholz
5,195,141 A 3/1993 Jang
5,210,806 A 5/1993 Kihara et al.
5,239,997 A 8/1993 Guarino et al.
5,355,417 A 10/1994 Burdisso et al.
5,361,381 A 11/1994 Short
5,384,856 A 1/1995 Kyouno et al.
5,420,929 A 5/1995 Geddes et al.
5,425,107 A 6/1995 Bertagni et al.
5,463,695 A 10/1995 Werrbach
5,465,421 A 11/1995 McCormick et al.
5,467,775 A 11/1995 Callahan et al.
5,473,214 A 12/1995 Hildebrand
5,515,444 A 5/1996 Burdisso et al.
5,539,835 A 7/1996 Bertagni et al.
5,541,866 A 7/1996 Sato et al.
5,572,443 A 11/1996 Emoto et al.
5,615,275 A 3/1997 Bertagni
5,617,480 A 4/1997 Ballard et al.
5,638,456 A 6/1997 Conley et al.
5,640,685 A 6/1997 Komoda
5,671,287 A 9/1997 Gerzon
5,693,917 A 12/1997 Bertagni et al.
5,699,438 A 12/1997 Smith et al.
5,727,074 A 3/1998 Hildebrand
5,737,432 A 4/1998 Werrbach
5,828,768 A 10/1998 Eatwell et al.
5,832,097 A 11/1998 Armstrong et al.
5,838,805 A 11/1998 Warnaka et al.
5,848,164 A 12/1998 Levine
5,861,686 A 1/1999 Lee
5,872,852 A 2/1999 Dougherty
5,883,339 A 3/1999 Greenberger
5,901,231 A 5/1999 Parrella et al.
5,990,955 A 11/1999 Koz
6,002,777 A 12/1999 Grasfield et al.
6,058,196 A 5/2000 Heron
6,078,670 A 6/2000 Beyer
6,093,144 A 7/2000 Jaeger et al.
6,108,431 A 8/2000 Bachler
6,195,438 B1 2/2001 Yumoto et al.
6,201,873 B1 3/2001 Dal Farra
6,202,601 B1 3/2001 Ouellette et al.
6,208,237 B1 * 3/2001 Saiki ..... H04M 1/03 340/388.1
6,263,354 B1 7/2001 Gandhi
6,285,767 B1 9/2001 Klayman
6,292,511 B1 9/2001 Goldston et al.
6,317,117 B1 11/2001 Goff
6,318,797 B1 11/2001 Böhm et al.
6,332,029 B1 12/2001 Azima et al.
6,343,127 B1 1/2002 Billoud
6,518,852 B1 2/2003 Derrick
6,529,611 B2 * 3/2003 Kobayashi ..... B06B 1/045 381/396
6,535,846 B1 3/2003 Shashoua
6,570,993 B1 * 5/2003 Fukuyama ..... G10K 9/22 340/388.1
6,587,564 B1 7/2003 Cusson
6,618,487 B1 * 9/2003 Azima ..... H04R 1/24 381/152
6,661,897 B2 12/2003 Smith
6,661,900 B1 12/2003 Allred et al.
6,772,114 B1 8/2004 Sluijter et al.
6,847,258 B2 1/2005 Ishida et al.
6,871,525 B2 3/2005 Withnall et al.
6,907,391 B2 6/2005 Bellora et al.
6,999,826 B1 2/2006 Zhou et al.
7,006,653 B2 2/2006 Guenther
7,016,746 B2 3/2006 Wiser et al.
7,024,001 B1 4/2006 Nakada
7,058,463 B1 6/2006 Ruha et al.
7,123,728 B2 10/2006 King et al.
7,254,243 B2 8/2007 Bongiovi
7,266,205 B2 9/2007 Miller
7,274,795 B2 9/2007 Bongiovi
7,519,189 B2 4/2009 Bongiovi
7,577,263 B2 8/2009 Tourwe
7,613,314 B2 11/2009 Camp, Jr.
7,676,048 B2 3/2010 Tsutsui
7,711,442 B2 5/2010 Ryle et al.
7,747,447 B2 6/2010 Christensen et al.
7,764,802 B2 7/2010 Oliver
7,778,718 B2 8/2010 Janke et al.
7,916,876 B1 3/2011 Helsloot
8,068,621 B2 11/2011 Okabayashi et al.
8,144,902 B2 3/2012 Johnston
8,160,274 B2 4/2012 Bongiovi
8,175,287 B2 5/2012 Ueno et al.
8,218,789 B2 7/2012 Bharitkar et al.
8,229,136 B2 7/2012 Bongiovi
8,284,955 B2 10/2012 Bongiovi et al.
8,385,864 B2 2/2013 Dickson et al.
8,462,963 B2 6/2013 Bongiovi
8,472,642 B2 6/2013 Bongiovi
8,503,701 B2 8/2013 Miles et al.
8,565,449 B2 10/2013 Bongiovi
8,705,765 B2 4/2014 Bongiovi
8,750,538 B2 6/2014 Avendano et al.
8,811,630 B2 8/2014 Burlingame
8,879,743 B1 11/2014 Mitra
9,195,433 B2 11/2015 Bongiovi et al.
9,264,004 B2 2/2016 Bongiovi et al.
9,276,542 B2 3/2016 Bongiovi et al.

(56) References Cited

U.S. PATENT DOCUMENTS

| | | | |
|---|---|---|---|
| 9,281,794 | B1 | 3/2016 | Bongiovi et al. |
| 9,344,828 | B2 | 5/2016 | Bongiovi et al. |
| 9,348,904 | B2 | 5/2016 | Bongiovi et al. |
| 9,350,309 | B2 | 5/2016 | Bongiovi et al. |
| 9,397,629 | B2 | 7/2016 | Bongiovi et al. |
| 9,398,394 | B2 | 7/2016 | Bongiovi et al. |
| 9,413,321 | B2 | 8/2016 | Bongiovi et al. |
| 9,564,146 | B2 | 2/2017 | Bongiovi et al. |
| 9,615,189 | B2 | 4/2017 | Copt et al. |
| 9,615,813 | B2 | 4/2017 | Copt et al. |
| 9,621,994 | B1 | 4/2017 | Bongiovi et al. |
| 9,638,672 | B2 | 5/2017 | Butera, III et al. |
| 9,741,355 | B2 | 8/2017 | Bongiovi et al. |
| 9,793,872 | B2 | 10/2017 | Bongiovi et al. |
| 2001/0008535 | A1 | 7/2001 | Lanigan |
| 2001/0043704 | A1 | 11/2001 | Schwartz |
| 2002/0057808 | A1 | 5/2002 | Goldstein |
| 2002/0094096 | A1 | 7/2002 | Paritsky et al. |
| 2003/0016838 | A1 | 1/2003 | Paritsky et al. |
| 2003/0023429 | A1 | 1/2003 | Claesson |
| 2003/0035555 | A1 | 2/2003 | King et al. |
| 2003/0043940 | A1 | 3/2003 | Janky et al. |
| 2003/0112088 | A1 | 6/2003 | Bizjak |
| 2003/0138117 | A1 | 7/2003 | Goff |
| 2003/0142841 | A1 | 7/2003 | Wiegand |
| 2003/0164546 | A1 | 9/2003 | Giger |
| 2003/0179891 | A1 | 9/2003 | Rabinowitz et al. |
| 2003/0216907 | A1 | 11/2003 | Thomas |
| 2004/0003805 | A1 | 1/2004 | Ono et al. |
| 2004/0022400 | A1 | 2/2004 | Magrath |
| 2004/0044804 | A1 | 3/2004 | Mac Farlane |
| 2004/0086144 | A1 | 5/2004 | Kallen |
| 2004/0103588 | A1 | 6/2004 | Allaei |
| 2004/0138769 | A1 | 7/2004 | Akiho |
| 2004/0146170 | A1 | 7/2004 | Zint |
| 2004/0189264 | A1 | 9/2004 | Matsuura et al. |
| 2005/0090295 | A1 | 4/2005 | Ali et al. |
| 2005/0117771 | A1 | 6/2005 | Vosburgh et al. |
| 2005/0129248 | A1 | 6/2005 | Kraemer et al. |
| 2005/0175185 | A1 | 8/2005 | Korner |
| 2005/0201572 | A1 | 9/2005 | Lindahl et al. |
| 2005/0249272 | A1 | 11/2005 | Kirkeby et al. |
| 2005/0254564 | A1 | 11/2005 | Tsutsui |
| 2006/0034467 | A1 | 2/2006 | Sleboda et al. |
| 2006/0064301 | A1 | 3/2006 | Aguilar et al. |
| 2006/0098827 | A1 | 5/2006 | Paddock et al. |
| 2006/0115107 | A1 | 6/2006 | Vincent et al. |
| 2006/0126851 | A1 | 6/2006 | Yuen et al. |
| 2006/0126865 | A1 | 6/2006 | Blamey et al. |
| 2006/0138285 | A1 | 6/2006 | Oleski et al. |
| 2006/0140319 | A1 | 6/2006 | Eldredge et al. |
| 2006/0153281 | A1 | 7/2006 | Karlsson |
| 2006/0189841 | A1 | 8/2006 | Pluvinage |
| 2006/0285696 | A1 | 12/2006 | Houtsma |
| 2006/0291670 | A1 | 12/2006 | King et al. |
| 2007/0010132 | A1 | 1/2007 | Nelson |
| 2007/0030994 | A1 | 2/2007 | Ando et al. |
| 2007/0119421 | A1 | 5/2007 | Lewis et al. |
| 2007/0165872 | A1 | 7/2007 | Bridger et al. |
| 2007/0173990 | A1 | 7/2007 | Smith et al. |
| 2007/0177459 | A1 | 8/2007 | Behn |
| 2007/0206643 | A1 | 9/2007 | Egan |
| 2007/0223713 | A1 | 9/2007 | Gunness |
| 2007/0223717 | A1 | 9/2007 | Boersma |
| 2007/0253577 | A1 | 11/2007 | Yen et al. |
| 2008/0031462 | A1 | 2/2008 | Walsh et al. |
| 2008/0040116 | A1 | 2/2008 | Cronin |
| 2008/0069385 | A1 | 3/2008 | Revit |
| 2008/0093157 | A1 | 4/2008 | Drummond et al. |
| 2008/0112576 | A1 | 5/2008 | Bongiovi |
| 2008/0123870 | A1 | 5/2008 | Stark |
| 2008/0123873 | A1 | 5/2008 | Bjorn-Josefsen et al. |
| 2008/0137876 | A1 | 6/2008 | Kassan et al. |
| 2008/0137881 | A1 | 6/2008 | Bongiovi |
| 2008/0165989 | A1 | 7/2008 | Seil et al. |
| 2008/0181424 | A1 | 7/2008 | Schulein et al. |
| 2008/0212798 | A1 | 9/2008 | Zartarian |
| 2008/0219459 | A1 | 9/2008 | Bongiovi et al. |
| 2008/0255855 | A1 | 10/2008 | Lee et al. |
| 2009/0022328 | A1 | 1/2009 | Neugebauer et al. |
| 2009/0054109 | A1 | 2/2009 | Hunt |
| 2009/0062946 | A1 | 3/2009 | Bongiovi et al. |
| 2009/0086996 | A1 | 4/2009 | Bongiovi et al. |
| 2009/0211838 | A1 | 8/2009 | Bilan |
| 2009/0282810 | A1 | 11/2009 | Leone et al. |
| 2009/0290725 | A1 | 11/2009 | Huang |
| 2009/0296959 | A1 | 12/2009 | Bongiovi |
| 2010/0166222 | A1 | 7/2010 | Bongiovi |
| 2010/0256843 | A1 | 10/2010 | Bergstein et al. |
| 2010/0278364 | A1 | 11/2010 | Berg |
| 2010/0303278 | A1 | 12/2010 | Sahyoun |
| 2011/0013736 | A1 | 1/2011 | Tsukamoto et al. |
| 2011/0087346 | A1 | 4/2011 | Larsen et al. |
| 2011/0096936 | A1 | 4/2011 | Gass |
| 2011/0194712 | A1 | 8/2011 | Potard |
| 2011/0230137 | A1 | 9/2011 | Hicks et al. |
| 2011/0257833 | A1 | 10/2011 | Trush et al. |
| 2012/0014553 | A1 | 1/2012 | Bonanno |
| 2012/0099741 | A1 | 4/2012 | Gotoh et al. |
| 2012/0170759 | A1 | 7/2012 | Yuen et al. |
| 2012/0189131 | A1 | 7/2012 | Ueno et al. |
| 2012/0213034 | A1 | 8/2012 | Imran |
| 2012/0213375 | A1 | 8/2012 | Mahabub et al. |
| 2012/0302920 | A1 | 11/2012 | Bridger et al. |
| 2013/0083958 | A1 | 4/2013 | Katz et al. |
| 2013/0121507 | A1 | 5/2013 | Bongiovi et al. |
| 2013/0162908 | A1 | 6/2013 | Son et al. |
| 2013/0163783 | A1 | 6/2013 | Burlingame |
| 2013/0169779 | A1 | 7/2013 | Pedersen |
| 2013/0220274 | A1 | 8/2013 | Deshpande et al. |
| 2013/0227631 | A1 | 8/2013 | Sharma et al. |
| 2013/0242191 | A1 | 9/2013 | Leyendecker |
| 2013/0288596 | A1 | 10/2013 | Suzuki et al. |
| 2013/0338504 | A1 | 12/2013 | Demos et al. |
| 2014/0067236 | A1 | 3/2014 | Henry et al. |
| 2014/0100682 | A1 | 4/2014 | Bongiovi |
| 2014/0112497 | A1 | 4/2014 | Bongiovi |
| 2014/0153730 | A1 | 6/2014 | Habboushe et al. |
| 2014/0153765 | A1 | 6/2014 | Gan et al. |
| 2014/0185829 | A1 | 7/2014 | Bongiovi |
| 2014/0261301 | A1 | 9/2014 | Leone |
| 2014/0369504 | A1 | 12/2014 | Bongiovi |
| 2014/0369521 | A1 | 12/2014 | Bongiovi et al. |
| 2014/0379355 | A1 | 12/2014 | Hosokawsa |
| 2015/0215720 | A1 | 7/2015 | Carroll |
| 2015/0297169 | A1 | 10/2015 | Copt et al. |
| 2015/0297170 | A1 | 10/2015 | Copt et al. |
| 2016/0036402 | A1 | 2/2016 | Bongiovi et al. |
| 2016/0044436 | A1 | 2/2016 | Copt et al. |
| 2016/0240208 | A1 | 8/2016 | Bongiovi et al. |
| 2016/0258907 | A1 | 9/2016 | Butera, III et al. |
| 2016/0344361 | A1 | 11/2016 | Bongiovi et al. |
| 2017/0033755 | A1 | 2/2017 | Bongiovi et al. |
| 2017/0041732 | A1 | 2/2017 | Bongiovi et al. |
| 2017/0289695 | A1 | 10/2017 | Bongiovi et al. |

FOREIGN PATENT DOCUMENTS

| | | | |
|---|---|---|---|
| AU | 2012202127 | | 7/2014 |
| BR | 96114177 | | 2/1999 |
| BR | 96113723 | | 7/1999 |
| CA | 2533221 | | 6/1995 |
| CA | 2161412 | | 4/2000 |
| CA | 2576829 | | 7/2014 |
| CN | 1173268 | A | 2/1998 |
| CN | 1221528 | A | 6/1999 |
| CN | 1910816 | A | 2/2007 |
| CN | 101536541 | A | 9/2009 |
| CN | 101946526 | A | 1/2011 |
| CN | 102265641 | | 11/2011 |
| CN | 102652337 | | 8/2012 |
| CN | 102772222 | A | 11/2012 |
| CN | 103004237 | A | 3/2013 |
| CN | 0780050323X | | 5/2013 |

(56) References Cited

FOREIGN PATENT DOCUMENTS

| | | | |
|---|---|---|---|
| CN | 203057339 | | 7/2013 |
| EP | 0206746 | B1 | 8/1992 |
| EP | 0541646 | | 1/1995 |
| EP | 0580579 | | 6/1998 |
| EP | 0698298 | | 2/2000 |
| EP | 0932523 | | 6/2000 |
| EP | 0666012 | | 11/2002 |
| EP | 2814267 | B1 | 10/2016 |
| ES | 2218599 | | 10/1998 |
| ES | 2249788 | | 10/1998 |
| ES | 2219949 | | 8/1999 |
| GB | 2003707 | A | 3/1979 |
| GB | 2320393 | | 12/1996 |
| ID | P0031074 | | 6/2012 |
| IN | 260362 | | 4/2014 |
| IS | 198914 | | 7/2014 |
| JP | 3150910 | | 6/1991 |
| JP | 7106876 | | 4/1995 |
| JP | 2005500768 | | 1/2005 |
| JP | 4787255 | | 7/2011 |
| JP | 5048782 | | 7/2012 |
| JP | 201543561 | | 3/2015 |
| KR | 1020040022442 | | 3/2004 |
| KR | 1020090101209 | | 9/2009 |
| KR | 101503541 | | 3/2015 |
| MO | J001182 | | 10/2013 |
| MX | 274143 | | 8/2005 |
| MX | 301172 | | 11/2006 |
| MX | 315197 | | 11/2013 |
| NZ | 553744 | | 1/2009 |
| NZ | 574141 | | 4/2010 |
| NZ | 557201 | | 5/2012 |
| PH | 12009501073 | | 11/2014 |
| RU | 2407142 | | 12/2010 |
| RU | 2483363 | | 5/2013 |
| SG | 152762 | | 12/2011 |
| SG | 155213 | | 2/2013 |
| SU | 1319288 | | 6/1987 |
| WO | WO 9219080 | | 10/1992 |
| WO | WO 1993011637 | | 6/1993 |
| WO | WO 9321743 | | 10/1993 |
| WO | WO 9427331 | | 11/1994 |
| WO | WO 9514296 | | 5/1995 |
| WO | WO 9531805 | | 11/1995 |
| WO | WO 9535628 | | 12/1995 |
| WO | WO 9601547 | | 1/1996 |
| WO | WO 9611465 | | 4/1996 |
| WO | WO 9708847 | | 3/1997 |
| WO | WO 9709698 | | 3/1997 |
| WO | WO 9709840 | | 3/1997 |
| WO | WO 9709841 | | 3/1997 |
| WO | WO 9709842 | | 3/1997 |
| WO | WO 9709843 | | 3/1997 |
| WO | WO 9709844 | | 3/1997 |
| WO | WO 9709845 | | 3/1997 |
| WO | WO 9709846 | | 3/1997 |
| WO | WO 9709848 | | 3/1997 |
| WO | WO 9709849 | | 3/1997 |
| WO | WO 9709852 | | 3/1997 |
| WO | WO 9709853 | | 3/1997 |
| WO | WO 9709854 | | 3/1997 |
| WO | WO 9709855 | | 3/1997 |
| WO | WO 9709856 | | 3/1997 |
| WO | WO 9709857 | | 3/1997 |
| WO | WO 9709858 | | 3/1997 |
| WO | WO 9709859 | | 3/1997 |
| WO | WO 9709861 | | 3/1997 |
| WO | WO 9709862 | | 3/1997 |
| WO | WO 9717818 | | 5/1997 |
| WO | WO 9717820 | | 5/1997 |
| WO | WO 9813942 | | 4/1998 |
| WO | WO 9816409 | | 4/1998 |
| WO | WO 9828942 | | 7/1998 |
| WO | WO 9831188 | | 7/1998 |
| WO | WO 9834320 | | 8/1998 |
| WO | WO 9839947 | | 9/1998 |
| WO | WO 9842536 | | 10/1998 |
| WO | WO 9843464 | | 10/1998 |
| WO | WO 9852381 | | 11/1998 |
| WO | WO 9852383 | | 11/1998 |
| WO | WO 9853638 | | 11/1998 |
| WO | WO 9902012 | | 1/1999 |
| WO | WO 9908479 | | 2/1999 |
| WO | WO 9911490 | | 3/1999 |
| WO | WO 9912387 | | 3/1999 |
| WO | WO 9913684 | | 3/1999 |
| WO | WO 9921397 | | 4/1999 |
| WO | WO 9935636 | | 7/1999 |
| WO | WO 9935883 | | 7/1999 |
| WO | WO 9937121 | | 7/1999 |
| WO | WO 9938155 | | 7/1999 |
| WO | WO 9941939 | | 8/1999 |
| WO | WO 9952322 | | 10/1999 |
| WO | WO 9952324 | | 10/1999 |
| WO | WO 9956497 | | 11/1999 |
| WO | WO 9962294 | | 12/1999 |
| WO | WO 9965274 | | 12/1999 |
| WO | WO 0001264 | | 1/2000 |
| WO | WO 0002417 | | 1/2000 |
| WO | WO 0007408 | | 2/2000 |
| WO | WO 0007409 | | 2/2000 |
| WO | WO 0013464 | | 3/2000 |
| WO | WO 0015003 | | 3/2000 |
| WO | WO 0033612 | | 6/2000 |
| WO | WO 0033613 | | 6/2000 |
| WO | WO 03104924 | | 12/2003 |
| WO | WO 2006020427 | | 2/2006 |
| WO | WO 2007092420 | | 8/2007 |
| WO | WO 2008067454 | | 6/2008 |
| WO | WO 2009070797 | | 6/2009 |
| WO | WO 2009114746 | | 9/2009 |
| WO | WO 2009155057 | | 12/2009 |
| WO | WO 2010027705 | | 3/2010 |
| WO | WO 2010051354 | | 5/2010 |
| WO | WO 2011081965 | | 7/2011 |
| WO | WO 2013055394 | | 4/2013 |
| WO | WO 2013076223 | | 5/2013 |
| WO | WO 2014201103 | | 12/2014 |
| WO | WO 2015061393 | | 4/2015 |
| WO | WO 2015077681 | | 5/2015 |
| WO | WO 2015161034 | | 10/2015 |
| WO | WO 2016019263 | | 2/2016 |
| WO | WO 2016022422 | | 2/2016 |
| WO | WO 2016144861 | A1 | 9/2016 |

OTHER PUBLICATIONS

Sepe, Michael. "Density & Molecular Weight in Polyethylene." Plastic Technology. Gardner Business Media, Inc., May 29, 2012. Web. http://ptonline.com/columns/density-molecular-weight-in-polyethylene.

* cited by examiner

SURFACE ACOUSTIC TRANSDUCER

CLAIM OF PRIORITY

The present application is a continuation-in-part application of previously filed, now pending application having Ser. No. 14/942,569, filed on Nov. 16, 2015, which matured into U.S. Pat. No. 9,621,994 on Apr. 11, 2017, and is incorporated herein by reference.

FIELD OF THE INVENTION

The present invention provides for a surface acoustic transducer, and accompanying systems and methods, optimally structured for an aircraft cabin. Specifically, a unique structural combination is provided in order to protect the excursion of a voice coil assembly (primary assembly) relative to a magnet, such as to mitigate the effects of external forces or interference. Further, a larger excursion range is provided by a spider in conjunction with a higher wattage voice coil, in order to allow for a richer sound range provided by the surface acoustic transducer.

BACKGROUND OF THE INVENTION

Where traditional loud speakers create sound by converting electric signals into mechanical motion in order to vibrate a diaphragm or cone, surface acoustic transducers operate to produce sound without a cone. That is, a surface acoustic transducer operates by attachment to a surface, such as an existing panel or wall made of various materials, and directing vibrations directly onto the surface in order to create sound.

Surface acoustic transducers are generally known in the art. For instance, a surface acoustic transducer might be created by merely removing the enclosure and cone from a traditional loud speaker or speaker driver, and attaching it to an external vibrational surface in order to create sound. However, although surface transducers have been known for some time, few have ever achieved commercial success due to the technical limitations of these transducers, and the resulting poor quality of sound by merely attaching the transducers to various surfaces.

Specifically, one limitation of surface acoustic transducers is due to the lack of a mechanical excursion, which causes an absence of highs and lows in sound frequency. For example, rather than achieving a rich bass sound, regular surface acoustic transducers have limited frequency response resulting in a lower quality narrow band response as compared to traditional loudspeakers. Another issue with surface transducers is the effect of the attached bracket surface or external housing for mounting the surface transducers. That is, structurally, current surface mounted transducers do not account for movement or variation of the vibrational surface to which the surface transducer is attached. For example, a person leaning against a wall or surface to which the surface transducer is attached to would have a drastic impact on the sound or sound quality being reproduced due to potential deflection of the transducer onto adjacent surfaces behind the application.

Therefore, there is a need in the industry for an improved surface acoustic transducer that produces a better sound and overcomes the particular problems described above.

SUMMARY OF THE INVENTION

The present invention meets the existing needs described above by providing for a structurally unique surface acoustic transducer and accompanying systems and methods. Specifically, the present invention provides for a surface acoustic transducer structured for producing high quality sound by vibrating an external surface. In a preferred embodiment of the present invention, the surface acoustic transducer of the present invention is optimally structured for producing high quality sound within an aircraft cabin. Of course, the present transducer may also be further configured and utilized to vibrate other surfaces.

Accordingly, in initially broad terms, a surface acoustic transducer of the present invention comprises a primary assembly and a transducer housing structured to retain the primary assembly therein.

The primary assembly is structured to house a voice coil assembly, include a voice coil former and a voice coil wire, and optionally a coupler ring. The primary assembly may form a substantially cylindrical shape, with a portion of its proximal end protruding outwardly from the transducer housing. The magnet is disposed at a distal end of the primary assembly. The coupler ring may be attached to a proximal end of the primary assembly. The primary body portion of the primary assembly may be formed from the voice coil former, having a voice coil wire wound in surrounding relations to at least a portion thereof.

The transducer housing may comprise a flange structure and a yoke structure, a spider, as well as a magnet, and top shunt plate attached and/or disposed therein. The flange structure forms a proximal portion of the transducer housing and the yoke structure forms a distal portion of the transducer housing. The yoke may be coupled or movably attached to a distal end of the primary assembly. The top shunt plate may be juxtaposed to a distal end of the primary assembly, and between the magnet and the primary assembly. More specifically, a top shunt plate may be disposed substantially within an interior of the voice coil former, and the voice coil wire may be wound external to the voice coil former at a portion thereof, such as to be disposed in a substantially overlying position relative to an external edge of the top shunt plate. The magnet may be attached and/or disposed to a distal surface of the transducer housing, such that a portion of the edge of the magnet is in overlying position relative to the voice coil wire of the voice coil assembly. The flange may be disposed in surrounding relation to an external surface of said voice coil assembly. A terminal attachment may be attached to a portion of the flange, and structured and disposed to receive an electrical input. A spider may be coupled to the flange in juxtaposing surrounding relation with the primary assembly, and more particularly the voice coil assembly forming a portion thereof. The spider may be disposed to mechanically dampen and/or at least partially impede the movement of the voice coil assembly as it is electrically excited from an electrical input signal.

An external housing or mounting bracket may further be provided to at least partially enclose the transducer housing therein. The external housing may comprise a cylindrical retaining wall of a rigid composition, and an excursion cover disposed and/or affixed thereon for protecting the transducer yet at the same time allowing for the excursion of the primary assembly therein.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE EMBODIMENT

As illustrated by the accompanying drawings, the present invention is directed to a surface acoustic transducer. In a preferred embodiment, the surface acoustic transducer of the present invention is optimally structured, as described below, for producing high quality sound within an aircraft cabin by vibrating its interior cabin walls, bulkheads, and/or windows. Of course, the present surface acoustic transducer may also be utilized to vibrate other surfaces. Specifically, the surface acoustic transducer of the present invention includes a transducer housing structured to at least partially enclose a primary assembly having a voice coil assembly and a magnet. In an embodiment, the transducer housing may further be mounted within an external housing or mounting bracket having a rigid retaining wall and an excursion cover. This excursion cover may be formed of a malleable helix structure such as to protect the surface acoustic transducer from external disturbance, yet at the same time allow for an excursion of the transducer via the excursion cover. This prevents or minimizes the distortion of sound when, for example, a person leans against a cabin wall to which a surface acoustic transducer is attached or other surfaces or materials that are in close or contacting proximity to the surface acoustic transducer, all without sacrificing the sound range and quality of the transducer.

Figure 1:
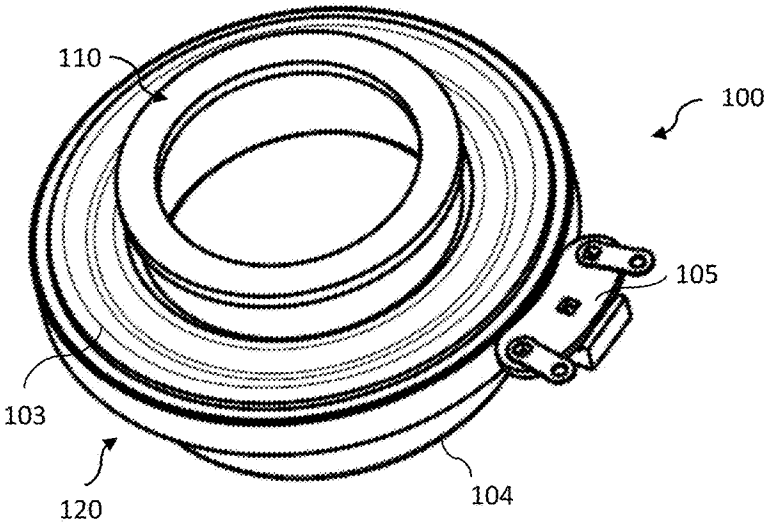
FIG. 1 is a perspective external view of a surface acoustic transducer in one embodiment of the present invention.
Figure 2:
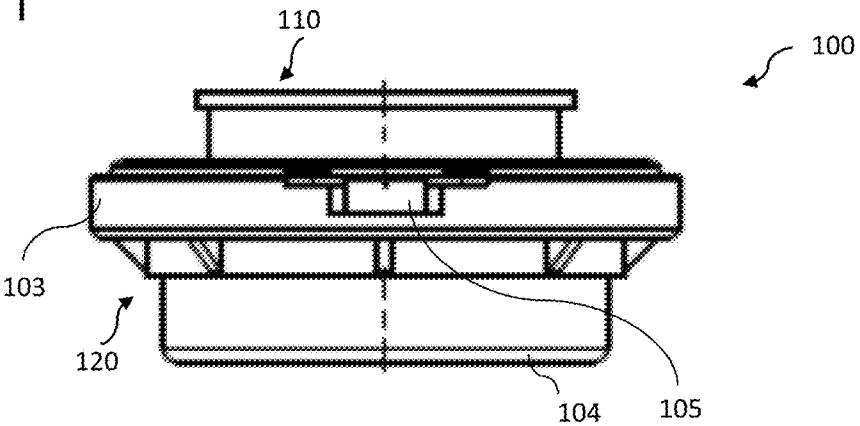
FIG. 2 is a bottom profile external view of the surface acoustic transducer of FIG. 1.

As schematically represented, FIGS. 1 and 2 illustrate a surface acoustic transducer 100 of the present invention. FIG. 1 provides a perspective view of the present transducer 100, and FIG. 2 provides a bottom profile view of the present transducer 100. As shown initially, the transducer 100 may exteriorly comprise a transducer housing 120 and a primary assembly 110 retained therein.

The primary assembly 110 may form a substantially cylindrical shape and may comprise and/or be formed at least partially from a voice coil assembly 117, with at least a portion of its proximal end protruding outwardly from the transducer housing 120. The transducer housing 120 may comprise a flange 103 forming a proximal portion of the transducer housing 120, and a yoke 104 forming a distal portion of the transducer housing 120. Further, the distal end of the primary assembly 110 may terminate within the yoke 104.

The flange 103 may be coupled to a proximal end of said transducer housing 120, forming a portion thereof. Said flange 103 being disposed in surrounding relations to the primary assembly 110. The flange 103 may comprise a terminal attachment 105 coupled to an end or edge of the flange as shown in the accompanying Figures. The terminal attachment 105 being structured with at least a positive terminal portion and negative terminal portion for receiving power from a power source, and further relay the power to a voice coil assembly 117. In at least one embodiment of the present invention, the transducer housing 120, or more particularly the diameter of the flange 103 comprises a diameter of between 25 mm to 30 mm.

The yoke 104 may be coupled to a distal end of said transducer housing 120, forming another portion thereof. The yoke 104 may be coupled in at least partially surrounding relation relative to a distal portion of the primary assembly 110.

Figure 3B:
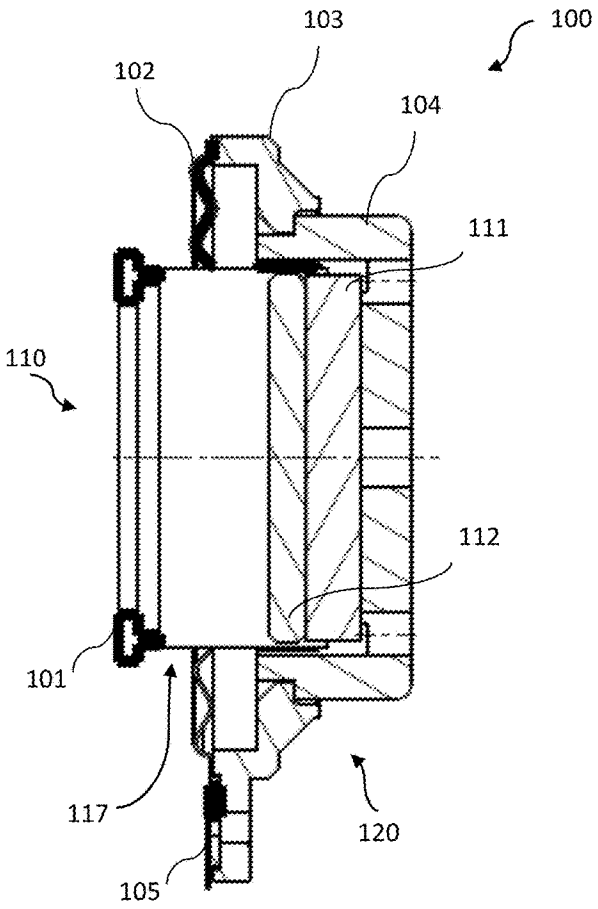
FIG. 3B is a side profile partially cut away view of the surface acoustic transducer of FIG. 1.
Figure 3A:
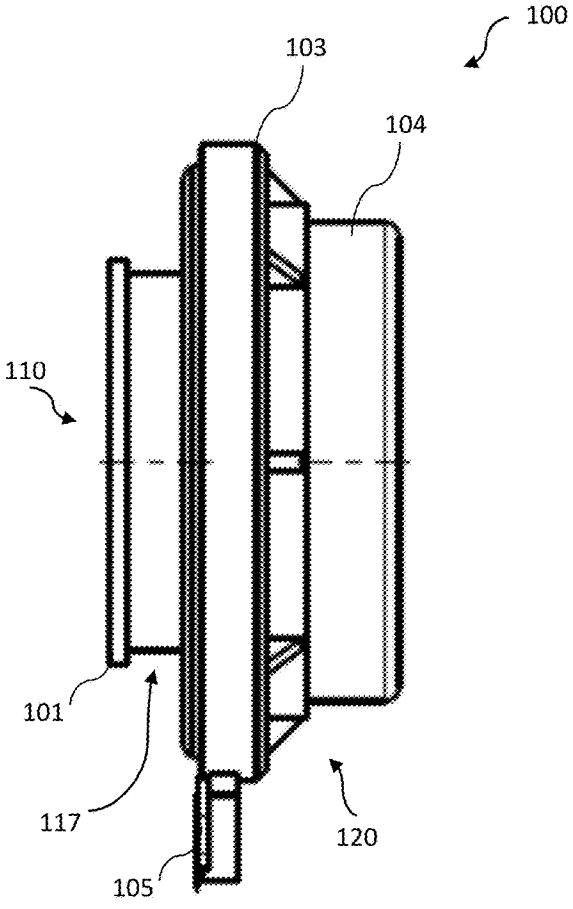
FIG. 3A is a side profile external view of the surface acoustic transducer of FIG. 1

Drawing attention to FIGS. 3A and 3B, respective side profile and partial cutaway side profile views of the surface acoustic transducer 100 are shown. As in FIG. 3A, the primary assembly 110 may further comprise a coupler ring 101 attached to a proximal end thereof. The primary assembly 110 may comprise a voice coil assembly 117 disposed between the coupler ring 101 and the yoke 104.

Drawing attention to FIG. 3B, a partial cutaway view of the surface acoustic transducer 100 further illustrates a spider 102 at least partially coupled to the flange 103, and structured to dampen the movement of the primary assembly 110 comprising the voice coil assembly 117. As such, the spider 102 may be coupled in surrounding relations to the primary assembly 110, or more specifically, a portion of the voice coil assembly 117. A magnet 111 providing a magnetic field may be coupled to a distal end of the transducer housing 120 and disposed in proximity to a distal end of the primary assembly 110 and/or voice coil assembly 117, and the voice coil wires 116 thereof, such as when the voice coil assembly 117 is in a resting state. A top shunt plate 112 may form circumferentially along a distal portion of the voice coil assembly 117, and disposed in juxtaposing relations to the magnet 111. Further, in at least one embodiment, the shunt plate 112 may have a slanted edge to prevent the build up of the magnetic field on the corners and improve the BL curve representing force factor relative to excursion distance.

Figure 4B:
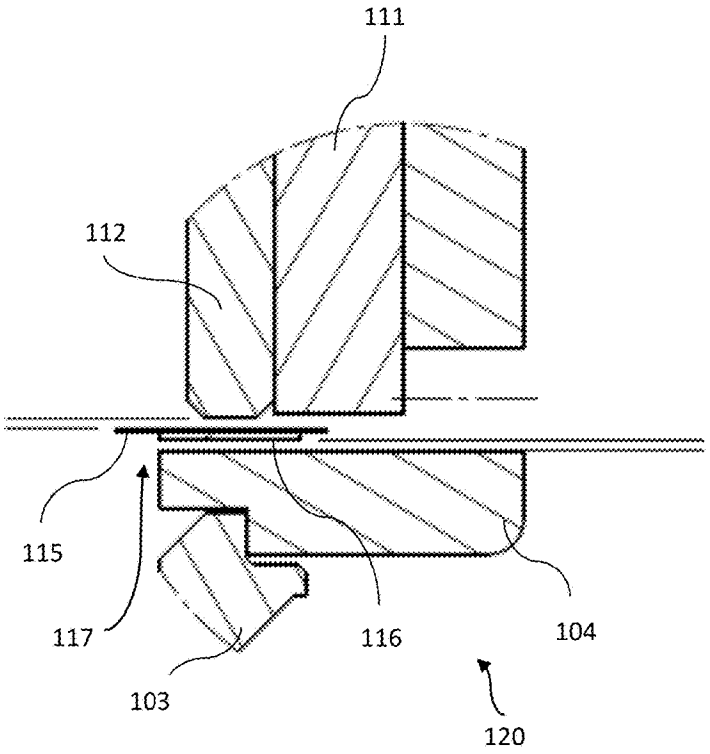
FIG. 4B is an expanded view of a cross section of the surface acoustic transducer shown in FIG. 4A.
Figure 4A:
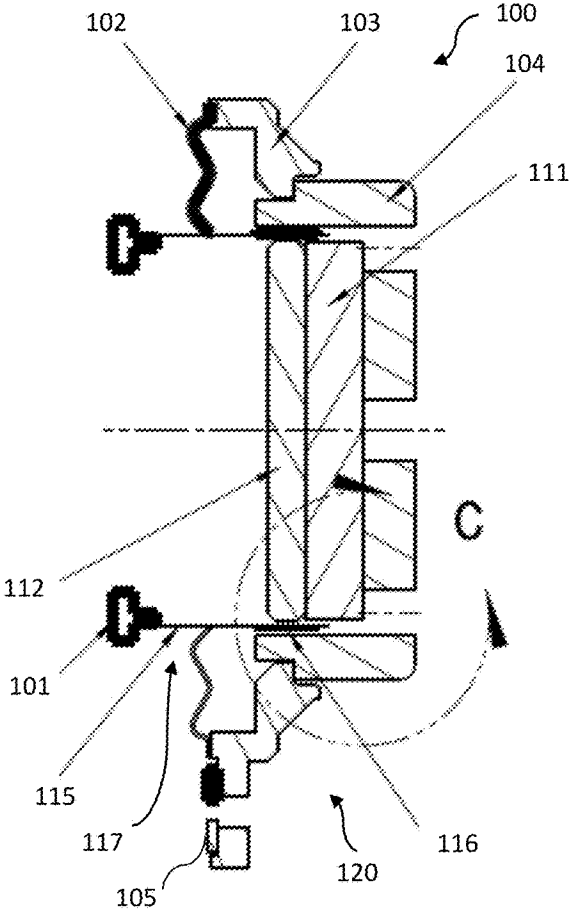
FIG. 4A is another side profile cut away view of the surface acoustic transducer of FIG. 1.

Drawing attention to FIG. 4A illustrating a cutaway view of the surface acoustic transducer 100, and more particularly FIG. 4B illustrating an exploded view of the cross section C, the voice coil assembly 117 comprises a voice coil former 115 and voice coil wire 116. The voice coil former 115 may comprise a cylindrical shape and may form a part or a portion of the voice coil assembly 117. The voice coil wire 116 may be wound in surrounding relations to at least a portion of the voice coil former 115, as illustrated in FIG. 4B, such that the voice coil wire 116 may be at least partially immersed within the magnetic field provided by the magnet 111.

In at least one embodiment of the present invention, a top shunt plate 112 may be disposed in substantially overlying relations relative to the voice coil wire 116, while only a portion of the magnet 111 is disposed in overlying relations relative to the voice coil wire 116, when the voice coil assembly 117 is at a rest state. Further, the magnet 111 of the present invention is preferably mounted at a distance of approximately 0.33 mm away (or providing a gap of 0.33 mm) from the voice coil assembly 117, to ensure that the magnet 111 and voice coil assembly 117 do not collide. In other embodiments, the gap will be preferably between various ranges of 0.25 to 0.4 mm. When the voice coil assembly 117 is in an excited state, such as when electrically excited by an input electrical signal via the terminal attachment 105 from an external power source, the voice coil assembly 117 may move in accordance with the received signal. The spider 102 coupled to the flange 103 is in juxtaposing surrounding relations with the voice coil assembly 117, such as to abut the voice coil former 115 in order to at least partially impede and/or dampen its movement. In a preferred embodiment, the spider 102 is formed of a flexible material such as to allow for a large excursion range or movement of the voice coil assembly 117.

Drawing attention back to FIG. 4A, and in at least one embodiment of the present invention, the transducer housing 120 is structured to house the primary assembly 110 including the voice coil assembly 117, and the magnet 111, such that the voice coil assembly 117 is disposed in movable relations relative to the magnet 111. In other words, the voice coil assembly 117 is movably attached to the transducer housing 120 comprising the flange 103 and the yoke 104, such that it may move axially outwards from the transducer housing 120 along a path of excursion during various excited state(s), and return to rest in a position as illustrated in FIGS. 4A and 4B.

Figure 12:
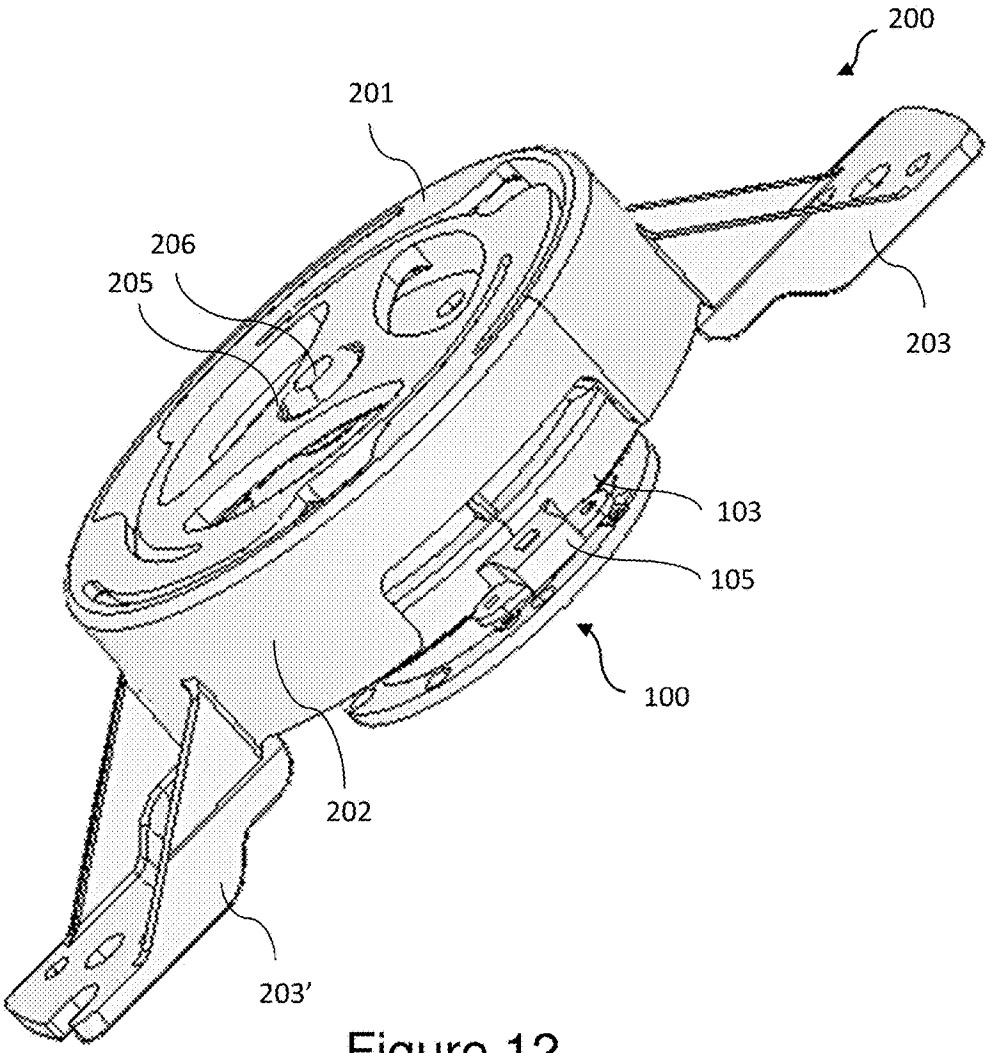
FIG. 12 is a profile view of a surface acoustic transducer mounted within an external housing.

Moving further to FIGS. 12-13, other embodiments of the present invention further comprises an external housing 200 utilized for mounting the surface acoustic transducer 100 described above onto a surface or material, such as an interior cabin, bulkhead, and/or window panel of an aircraft. As indicated in FIG. 12, the external housing 200 may at least partially enclose the surface acoustic transducer 100, in order to retain the transducer 100 therein and attach the same to a surface 75 via at least one mounting bracket, such as mounting bracket(s) 203 and/or 203'. When mounted or installed therein, the transducer 100 maintains a center alignment with the external housing 200, and a center line screw 206 may be utilized to stabilize and affix the transducer 100 within the external housing 200, such that the screw may cooperatively enter a center aperture 205 of an excursion cover 201 forming on a proximal portion of the external housing 200, and reach distally down towards the yoke 104 attached to or forming the distal portion of the transducer housing 120, and therefore serving as a structural securing mechanism.

Figure 13A:
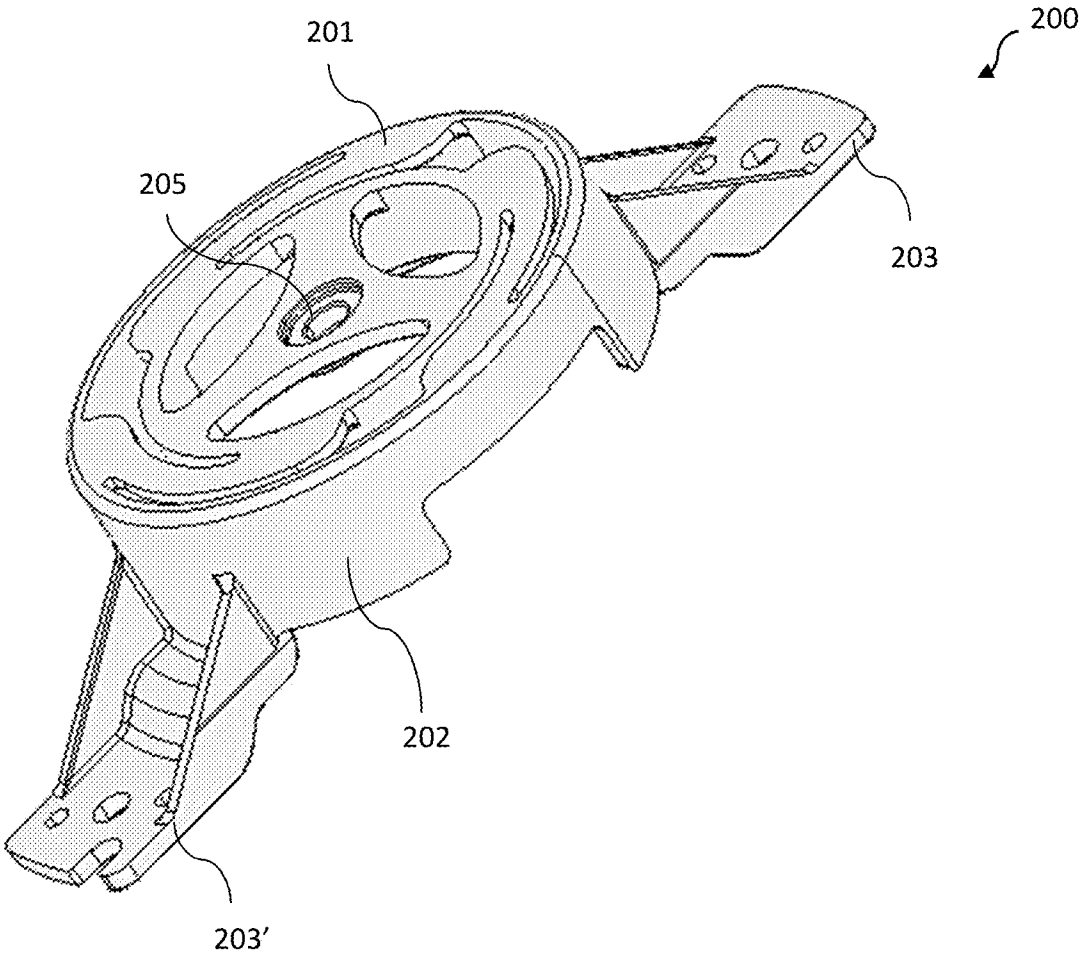
FIG. 13A is a profile view of the external housing of FIG. 12.
Figure 13C:
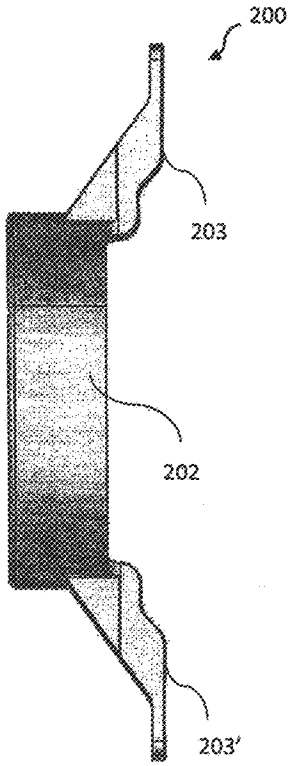
FIG. 13C is a side view of the external housing of FIG. 12.
Figure 13B:
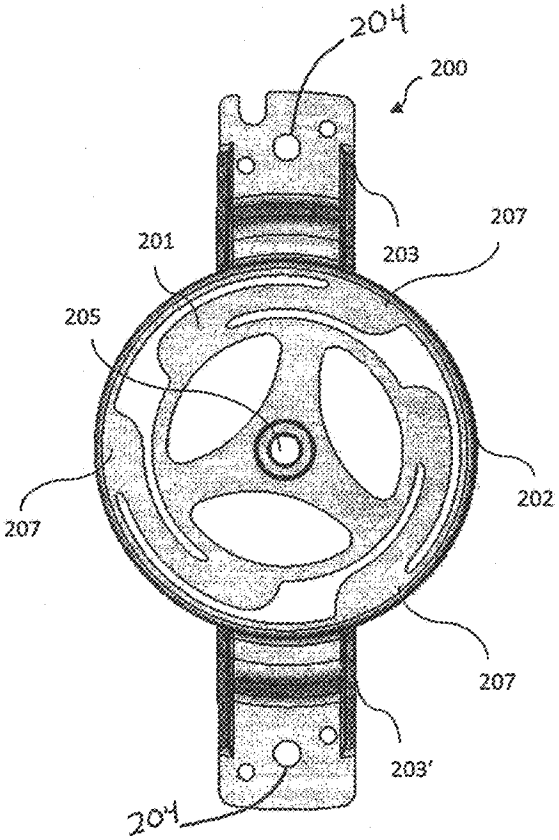
FIG. 13B is a top down view of the external housing of FIG. 12.
Figure 16:
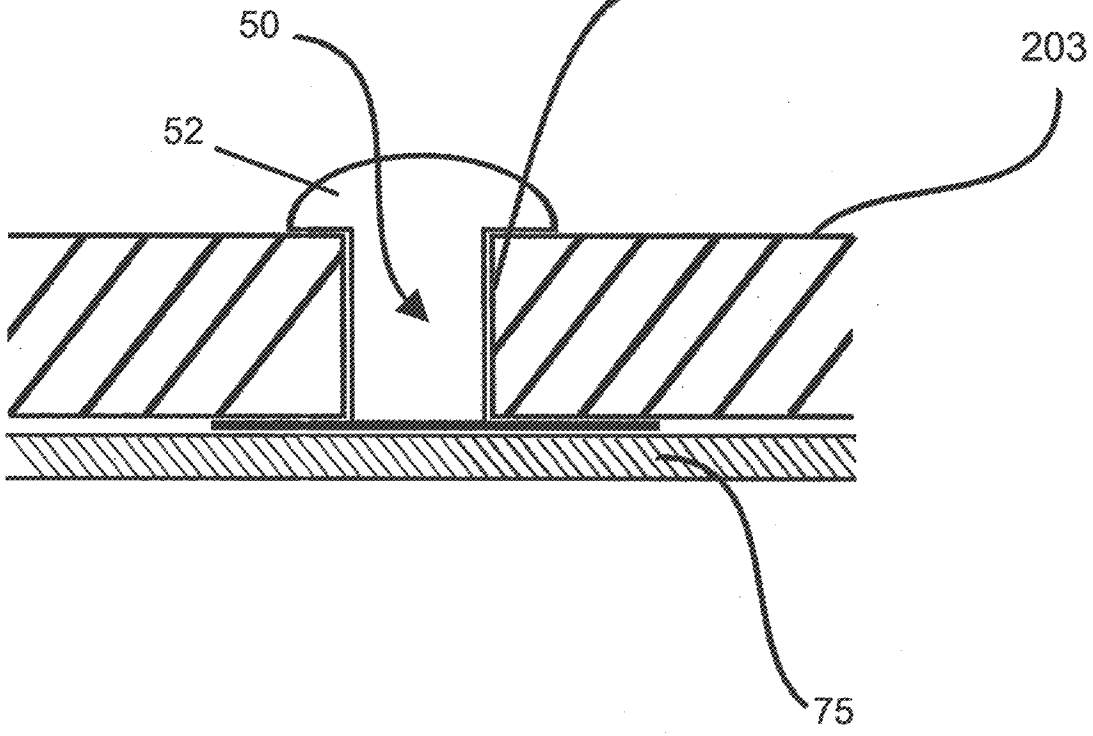
FIG. 16 is an isolated cross section view demonstrating a preferred use of an adhesive to secure the mounting brackets to an underlying surface.

Drawing attention to additional details in FIGS. 13A-13C, the external housing 200 generally comprises a retaining wall 202, at least one mounting bracket 203 and/or 203', and an excursion cover 201. The retaining wall 202 is preferably formed of a cylindrical shape and rigid composition such as to protect the interior thereof from external forces, such as when a person leans against a surface or interior cabin of an aircraft that the surface transducer 100 and external housing 200 are attached to. As such, the retaining wall 202 may further be attached to, or formed with, at least one mounting bracket 203 and/or 203', comprising at least one aperture 204 on each bracket so as to secure the external housing 200 to a substantially flat surface by conventional means, such as nails or screws, or adhesive. In one embodiment, the mounting brackets or alternatively, their respective apertures 204, may be optional as the external housing 200 may be secured to a surface via adhesives. In another embodiment, detailed in FIG. 16, the mounting brackets 203, 203' or alternatively, their respective apertures 204 may allow mechanical reinforcement of bonding from adhesive 50 as adhesive flows into the aperture 204 and onto the opposing surface 75 creating an enlarged area 52, exterior of the apertures 204 which may have a general "mushroom" shape when dry resulting in additional mechanical fastening strength. In particular, based upon the configuration of the present transducer assembly, the use of an adhesive 50 bond may be optimal in certain embodiments. Moreover, if desired, to provide additional strength, in addition to the normal bonding strength based upon surface to surface contact between the mounting brackets 203, 203' and the surface 75, a mechanical bond is also created by the enlarged area 52 acting much like the head of a rivet or screw to hold down the mounting brackets 203, 203' onto the surface 75. It is noted that although in the preferred embodiment the mounting brackets 203, 203' are being mounted to the same underlying surface 75 as the coupler ring 101, in alternate embodiments they may be mounted to different, attached or isolated surfaces.

The excursion cover 201 is formed on or attached to the retaining wall 202 via a plurality of contact portions 207. In the embodiment illustrated in FIG. 13B, the excursion cover 201 comprises a spiral or helix structure having three contact portions 207, such as to provide a degree of protection to the transducer 100 housed therein, yet at the same time allow for the excursion of the transducer 100, and more specifically its primary assembly and/or voice coil assembly outwardly. In other words, the structural configuration, composition, contact portions, and/or combinations therefore, support the malleability of the excursion cover 201, which may also move outwardly in response to the transducer 100 entering excited state(s), and therefore help support a richer and more vibrant sound rather than dampening it. Of course, in other embodiments, it should be understood that two or more contact portions 207, in addition to various compositional and physical characteristics of the excursion cover 201, may be used, depending on the degree of malleability or rigidness required.

In one embodiment, the external housing 200 may be formed from injection molding as an injection molding resin including but not limited to polypropylene, polyethylene, ABS, polycarbonate, glass reinforced molding resin, injection molding resin with flame retardant. In other embodiments, the external housing 200 may be formed from steel stamping, and/or other appropriate materials known to those skilled in the art.

Drawing attention to back to FIGS. 5-11, each element of the transducer 100 of the present invention is further shown separately in perspective views.

Figure 5:
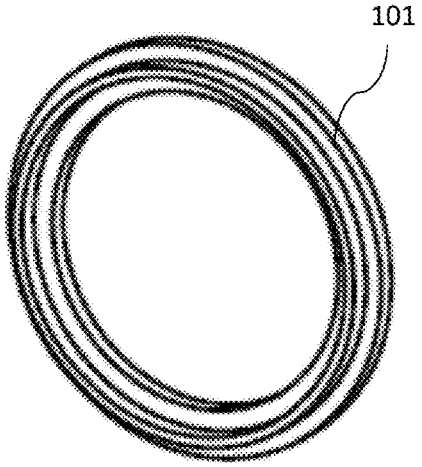
FIG. 5 is a profile view of a coupler ring forming part of the surface acoustic transducer of the present invention.

FIG. 5 illustrates a coupler ring 101 of the present invention. The material composition of the coupler ring 101 may comprise polycarbonate, plastic, and/or other appropriate materials or combinations thereof. The coupler ring 101 may be intended to be disposed against an external surface, such as an aircraft's interior cabin, in order to transfer the vibrations from the primary assembly for the production of sound.

Figure 6:
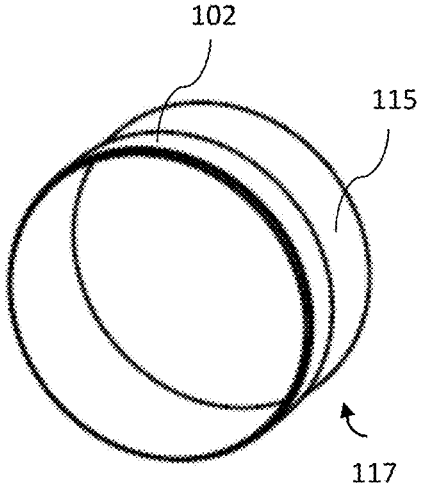
FIG. 6 is a profile view of the coupler ring of FIG. 5 in connection with a voice coil assembly forming part of the surface acoustic transducer of the present invention.

FIG. 6 illustrates a voice coil assembly 117 comprising a voice coil former 115 attached to the coupler ring 101. The voice coil former 115 is preferably formed of aluminum, but may also utilize other appropriate materials. The voice coil former 115 may comprise a thickness of approximately 0.05 mm in a preferred embodiment of the present invention. A voice coil wire 116 may be wound in surrounding relation to the voice coil former 115. In a preferred embodiment, the voice coil former 115 and wire 116 may comprise a diameter of 20-28 mm. In another embodiment, a single layer winding of the voice coil wire may result in a diameter of 26.5 mm. In another embodiment, a two layer winding may result in a diameter of 26.8 mm. The voice coil wire 116 is preferably formed of copper, but may also utilize other appropriate materials. In at least one embodiment of the present invention, the surface acoustic transducer 100 comprises a voice coil having a wattage of between 20 W to 30 W. In a preferred embodiment, the voice coil will have a wattage of 25 W.

Figure 7:
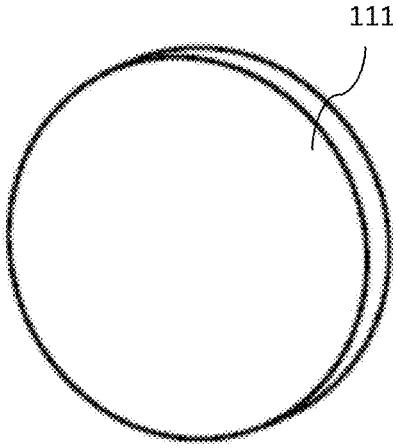
FIG. 7 is a profile view of a magnet forming part of the surface acoustic transducer of the present invention.

FIG. 7 illustrates a magnet 111 of the present invention for providing a magnetic field to the voice coil assembly 117 and voice coil wire 116 thereof. The magnet 111 may comprise a neodymium iron boron (NdFeB) N42H magnet in at least one embodiment. Of course, other grades of NdFeB ranging from N24 to N52 may be used in other various embodiments of the present invention. Various other materials may include Alnico (AlNiCo), Samarium Cobalt (SmCo), as well as other known and appropriate rare-earth magnet or permanent magnets may be utilized. In a preferred embodiment, the magnet comprises a substantially cylindrical and/or disc shape or profile.

Figure 8:
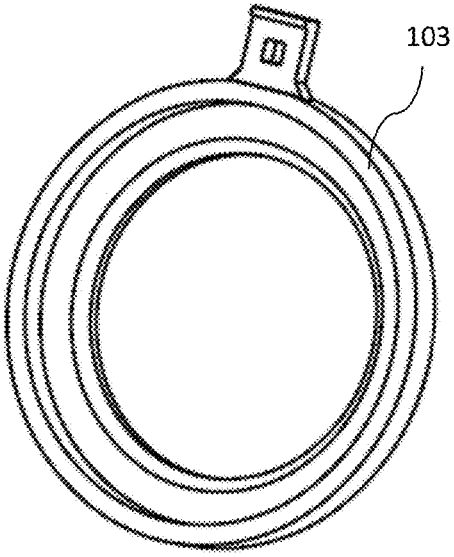
FIG. 8 is a profile view of a flange forming part of the surface acoustic transducer of the present invention.

FIG. 8 illustrates a flange 103 of the present invention, and structured to retain a terminal attachment 105 for receiving electrical input from an external source. The material composition of the flange 103 may comprise a polycarbonate or plastic compound and/or mixture.

Figure 9:
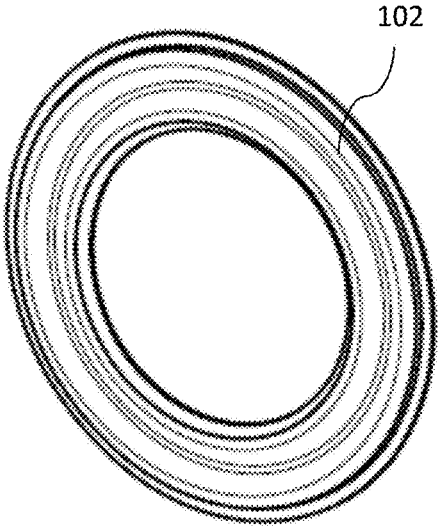
FIG. 9 is a profile view of a spider forming part of the surface acoustic transducer of the present invention.

FIG. 9 illustrates a spider 102 of the present invention, and structured and cooperatively disposed to dampen or at least partially impede the movement of the voice coil assembly 117. The material composition of the spider 102 may comprise a resin dipped cloth or fabric. However, other flexible materials and/or coatings known to those skilled in the art may also be used in order to accomplish a desired mechanical compliance (or the inverse of stiffness). The preferred mechanical compliance of the spider 102 is 0.23 millimeters per Newton (mm/n), offering a greater excursion range (less damping) than other transducers known in the art. A range of between 0.2 mm/N to 0.3 mm/N may also be used in various other embodiments.

Figure 10:
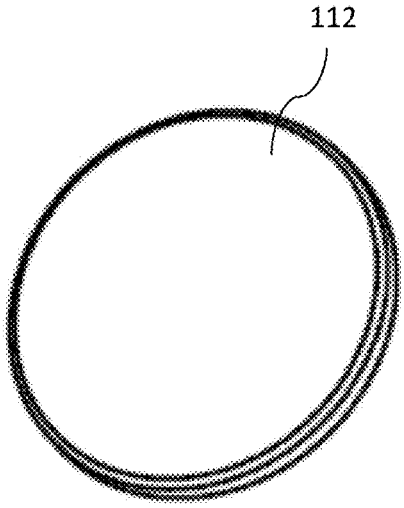
FIG. 10 is a profile view of a top shunt plate forming part of the surface acoustic transducer of the present invention.

FIG. 10 illustrates a top shunt plate 112 of the present invention, preferably coupled to the magnet 111 of the present invention. The material composition of the top shunt plate 112 may comprise a mild steel or low carbon steel such as EN1A, but may also comprise other appropriate metals known to those skilled in the art.

Figure 11:
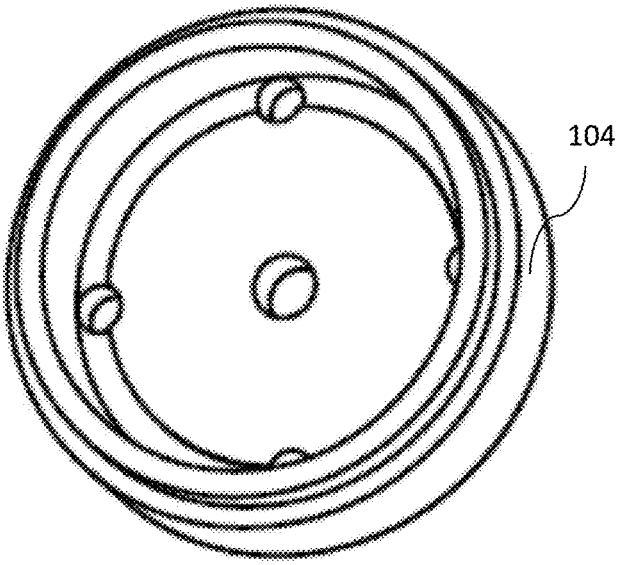
FIG. 11 is a profile view of a yoke forming part of the surface acoustic transducer of the present invention.

FIG. 11 illustrates a yoke 104 of the present invention, forming a distal end of the transducer housing 120. As shown, the yoke may comprise a plurality of taps for the insertion of screws such as M4 screws or other screws for affixing and stabilizing the transducer housing 120. The yoke 104 may similarly comprise a mild steel or low carbon steel such as EN1A, but may also comprise other appropriate metals known to those skilled in the art.

Further embodiments of the present invention are directed to systems and methods for using the surface acoustic transducer of the present invention, or like transducers, in order to produce quality sound and/or for noise cancelling applications.

In at least one system embodiment of the present invention, a plurality of surface acoustic transducers, such as the transducer 100 described above, may be attached a panel or surface such as a window, a wall, or an interior cabin of a vehicle. Specifically, one embodiment may be directed to an aircraft window panel having a plurality of surface acoustic transducers disposed thereon and hidden beneath the bulkhead or cabin wall within an aircraft.

Figure 14:
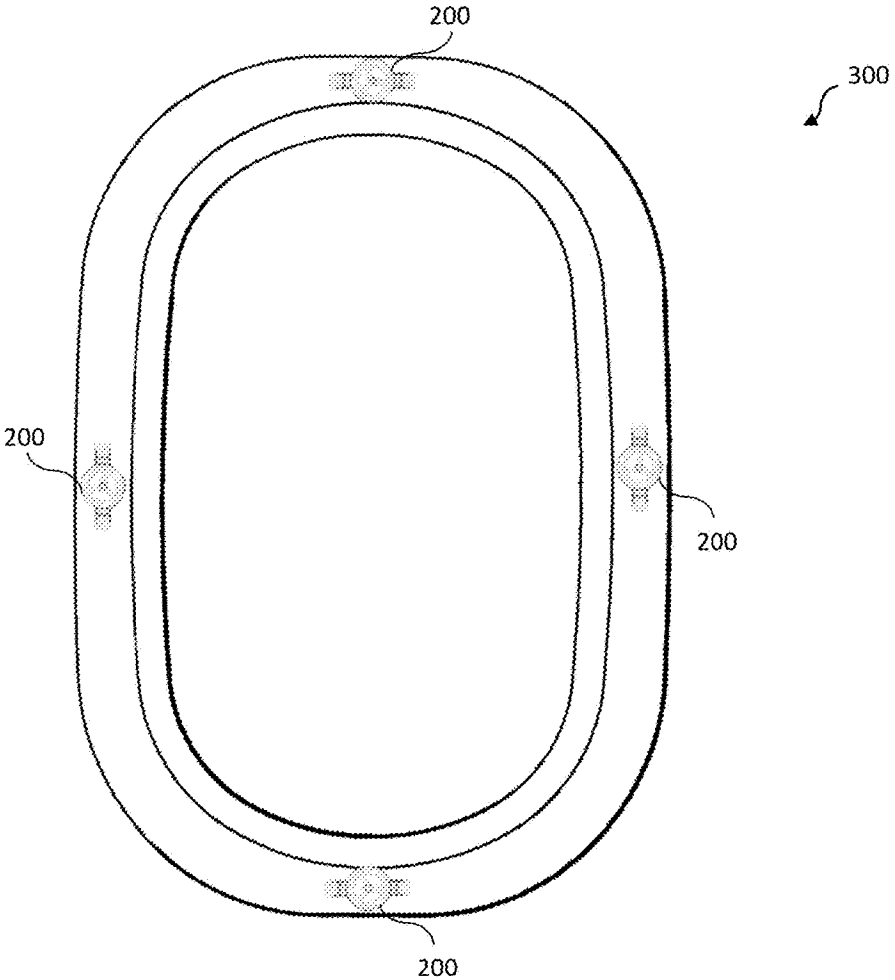
FIG. 14 is a schematic view of an active noise cancellation system utilizing one or more of the surface acoustic transducers of FIG. 1 mounted along a periphery of an aircraft window panel via the external housing of FIG. 12.
Figure 15:
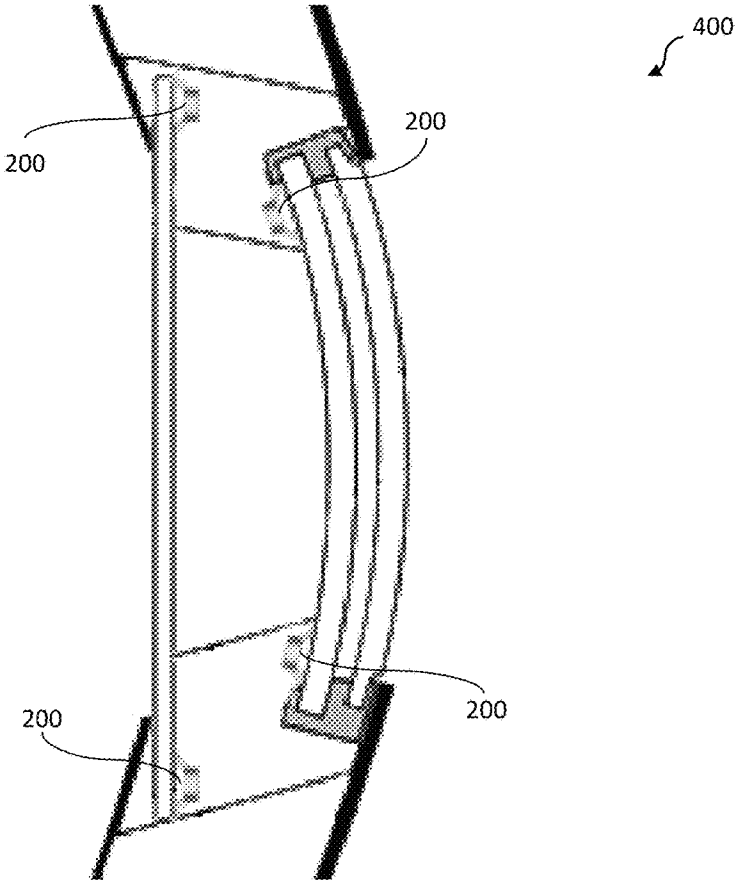
FIG. 15 is a schematic view of another active noise cancellation system utilizing one or more of the surface acoustic transducers of FIG. 1 mounted along a periphery of an aircraft window area via the external housing of FIG. 12.

At least one embodiment of the panel may be directed to noise cancelling operations for reducing the net vibration of the window and/or various panels or surfaces in proximity thereof. As such, a plurality of surface transducers may be mounted to a surface of a window and/or window panel underneath a bulkhead or other non-visible area internal to an aircraft cabin, as external noise generally resonates loudest at the windows. Ideally, the transducers are mounted along a perimeter of the window, so as to avoid obstruction of the view, such as general illustrated in FIGS. 14 and 15 as systems 300 and 400 respectively. These Figures and systems are example embodiments of various configurations of transducer 100 placement via external housing 200, and are by no means limiting. In other words, any number of transducers 100 may be mounted via housing 200 on one or more external and/or internal structural window panels, dust covers, chromatic and/or electrochromatic panels, glass, or other transparent materials, as well as nontransparent bulkhead connections, that may act as points of entry of external sound such as engine noise into an interior cabin of an aircraft or other vehicle.

The panel may further comprise various components configured for active noise control (ANC) or noise cancellation, such as to cause the plurality of transducers to emit an anti-noise signal in order to counter the noise source, and installed or disposed within an interior or non-visible portion of an aircraft cabin in proximity to the window panels whether by wired or wireless communication to each of the transducers 100. For example, the panel may comprise a power source, a receiver module, a processing unit, and at least one transducer. The receiver module may be mounted within an interior or exterior of the panel, or may be mounted remotely and be communicably connected to the panel and the processing unit. The receiver module may comprise a microphone, and is configured to receive sound signals or noise signals to relay to the processing unit. The processing unit is configured to receive the noise signals and produce an anti-noise signal, which may comprise a sound signal with the same amplitude but with an inverted phase relative to the noise signal (or antiphase). This anti-noise signal is then transmitted to the at least one transducer to be reproduced at the panel, therefore canceling any noises received by the receiver module, such as external engine noise.

Other embodiments of the present invention may be directed to methods for sound processing as directed to a surface acoustic transducer, such as transducer 100 described above. As discussed, one known limitation in the art is the inadequacy of bass frequencies of surface transducers, primarily due to their mechanical limitations, i.e. the lack of adequate mechanical excursion. To overcome this limitation, and in order to provide a richer bass sound, a method of the present invention contemplates first selecting the various points at which to limit the peak decibels of a sound signal. Next, the sound is processed at these points, such that the amplitude of the sound signal is reduced and its frequency proportionately enhanced. This, and other sound processing methodology may be accomplished pursuant to the Applicant's digital signal processing methods as recited in U.S. Pat. No. 8,160,274, which is hereby incorporated by reference in its entirety.

It should be understood that the above steps may be conducted exclusively or nonexclusively and in any order. Further, the physical devices recited in the methods may comprise any apparatus and/or systems described within this document or known to those skilled in the art.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A surface acoustic transducer assembly comprising:

a magnet providing a magnetic field, a primary assembly comprising a voice coil assembly having a cylindrically shaped voice coil former and a voice coil wire wound in surrounding relations to an exterior of said voice coil former, wherein said magnet is disposed at least partially within an interior of said voice coil assembly, a transducer housing structured to retain said voice coil assembly and said magnet therein, and an external housing comprising a retaining wall having a cylindrical profile and an excursion cover cooperatively structured to retain said transducer housing and said voice coil assembly therein, said excursion cover malleably attached to a proximal end of said retaining wall via a plurality of contact portions to allow for the excursion of said primary assembly outwards from said external housing, and said external housing secured to an underlying surface at a mounting bracket, said mounting bracket comprising at least one aperture structured to receive passage of at least a portion of an adhesive therethrough during hardening, said adhesive comprising an enlarged area engaging said mounting bracket opposite the underlying surface to mechanically retain said mounting bracket to the underlying surface.

2. The surface acoustic transducer assembly of claim 1 further comprising a top shunt plate coupled to a proximal surface of said magnet, wherein an exterior edge of said top shunt plate is disposed in overlying relation to said voice coil wire, when the surface acoustic transducer is in a rest state.

3. The surface acoustic transducer assembly of claim 2 wherein an exterior edge of said magnet is disposed in partially overlying relation to said voice coil wire, when the surface acoustic transducer is in a rest state.

* * * * *